US010350450B2

(12) United States Patent
Stelmach et al.

(10) Patent No.: US 10,350,450 B2
(45) Date of Patent: Jul. 16, 2019

(54) LATERAL TILTING TREADMILL SYSTEMS

(71) Applicants: John Stelmach, Oley, PA (US); Matthew Sommerfield, Allentown, PA (US); Brendan Haentjens, Bethlehem, PA (US)

(72) Inventors: John Stelmach, Oley, PA (US); Matthew Sommerfield, Allentown, PA (US); Brendan Haentjens, Bethlehem, PA (US)

( * ) Notice: Subject to any disclaimer, the term of this patent is extended or adjusted under 35 U.S.C. 154(b) by 261 days.

(21) Appl. No.: 15/405,003

(22) Filed: Jan. 12, 2017

(65) Prior Publication Data

US 2017/0197110 A1 Jul. 13, 2017

Related U.S. Application Data

(60) Provisional application No. 62/278,076, filed on Jan. 13, 2016.

(51) Int. Cl.

| | |
|---|---|
| ***A63B 22/02*** | (2006.01) |
| ***A63B 24/00*** | (2006.01) |
| ***A63B 21/00*** | (2006.01) |

(52) U.S. Cl.

CPC ..... *A63B 22/0235* (2013.01); *A63B 21/4035* (2015.10); *A63B 24/0087* (2013.01); *A63B 2225/09* (2013.01)

(58) Field of Classification Search

CPC ..... A63B 22/02–0264

See application file for complete search history.

(56) References Cited

U.S. PATENT DOCUMENTS

| | | | |
|---|---|---|---|
| 3,643,943 | A | 2/1972 | Erwin, Jr. |
| 3,731,917 | A | 5/1973 | Townsend |
| 3,826,491 | A | 7/1974 | Elder |
| 4,344,616 | A | 8/1982 | Ogden |
| D270,555 | S | 9/1983 | Ogden |
| D273,029 | S | 3/1984 | Kullenberg |
| 4,616,822 | A | 10/1986 | Trulaske |
| 4,844,449 | A | 7/1989 | Truslaske |

(Continued)

FOREIGN PATENT DOCUMENTS

| | | |
|---|---|---|
| CN | 2810671 Y | 8/2006 |
| CN | 101896152 B | 12/2014 |

OTHER PUBLICATIONS

Ivanenko, Y.P. et al., "Gait transitions in simlated reduced gravity," J. Appl. Physiol, vol. 110, pp. 781-788, 2011.

(Continued)

*Primary Examiner* — Nyca T Nguyen
(74) *Attorney, Agent, or Firm* — FisherBroyles, LLP

(57) ABSTRACT

A lateral tilting system comprising one or more crossbeams that are each pivotably supported by a respective base member for pivotable motion about a common longitudinal axis. A drive mechanism is operably connected to a drive shaft to mechanically drive pivotable motion of the crossbeams about the axis, and resulting lateral tilt of an associated treadmill deck. A control system may be included to receive a user's input for controlling an oscillation rate or other parameter of the lateral tilting, and optionally longitudinal incline of the treadmill deck. A novel treadmill including a lateral tilting system and a lateral tilting accessory for conventional exercise equipment are provided also.

14 Claims, 9 Drawing Sheets

(56) References Cited

U.S. PATENT DOCUMENTS

| | | | | |
|---|---|---|---|---|
| 7,717,830 | B1 * | 5/2010 | Charniga | A63B 22/0023 482/54 |
| 9,028,368 | B2 | 5/2015 | Ashby | |
| 9,498,673 | B2 * | 11/2016 | Tung | A63B 22/0605 |
| 9,616,278 | B2 | 4/2017 | Olson | |
| 9,927,312 | B1 * | 3/2018 | Berme | A63B 22/025 |
| 2002/0055422 | A1 * | 5/2002 | Airmet | A63B 22/16 482/61 |
| 2008/0318737 | A1 * | 12/2008 | Chu | A63B 22/0023 482/54 |
| 2010/0248900 | A1 * | 9/2010 | Ashby | A63B 22/02 482/4 |
| 2010/0304931 | A1 | 12/2010 | Stumpf | |
| 2012/0071301 | A1 * | 3/2012 | Kaylor | A63B 21/00058 482/57 |
| 2012/0302408 | A1 | 11/2012 | Burger | |
| 2013/0211594 | A1 | 8/2013 | Stephens | |
| 2013/0231219 | A1 | 9/2013 | Huang | |
| 2013/0274069 | A1 | 10/2013 | Watterson | |
| 2015/0328497 | A1 * | 11/2015 | Doucot | A63B 23/08 482/146 |

OTHER PUBLICATIONS

Watson, Oliver, "Force Measurement: AMTI Instrumented Treadmills," zFlo, Inc—Motion Analysis Blog, Dec. 19, 2013, pp. 1-6.

* cited by examiner

LATERAL TILTING TREADMILL SYSTEMS

CROSS-REFERENCES TO RELATED APPLICATIONS

This application claims priority to U.S. Provisional Application No. 62/278,076 filed on Jan. 13, 2016, the entire disclosure of which is hereby incorporated herein by reference.

FIELD OF THE INVENTION

The present invention relates generally to exercise treadmills having a deck supporting a movable treadmill belt, and more particularly, to a novel treadmill having a tilting deck feature that reduces stress and/or wear on the anatomy of a user of the treadmill, and thus tends to avoid joint and other physical injuries, and to an accessory to conventional treadmills for causing lateral tilting of a treadmill deck.

BACKGROUND

Exercising treadmills of various configurations are in widespread use. Generally, such treadmills permit walking or running "in place" indoors to maintain a program of physical fitness or for medical testing purposes. Generally, exercise treadmills include a frame extending lengthwise of the treadmill that supports a treadmill deck. The deck generally includes a pair of laterally spaced apart side rails supporting a pair of longitudinally spaced apart (front and rear) rollers interposed therebetween and journaled with respect to the side rails. These rollers extend generally horizontally, and an endless treadmill belt is entrained around the rollers and the upper reach of the belt is supported by a bed or the like to provide surface that will support a user of the treadmill while walking or running thereon. The treadmill belt is driven by an electric motor or the like such that the upper reach of the belt moves from front to rear over the bed, thus permitting a user of the treadmill to walk or run in a forward direction on the moving belt so as to remain stationary with respect to the frame of the treadmill. Typically, the speed of the treadmill belt can be varied.

For a general description of such treadmills, reference may be made to our U.S. Pat. No. 4,616,822, issued Oct. 14, 1986, which is hereby incorporated herein by reference.

In addition to increasing or decreasing the speed of the belt to vary the amount of physical exertion expended by a user of the treadmill, it is common for the treadmill to have an elevation system that selectively raises the front of the treadmill belt/deck relative to the rear of the treadmill belt/deck, thus inclining the jogging or walking surface such that a person walking or jogging on the upper reach of the treadmill belt will, in essence, be required to walk or run uphill, thus expending additional energy. Examples of such an elevation system are provided in U.S. Pat. Nos. 3,643,943, 3,731,917, 3,826,491, 4,344,616, and in U.S. Design Pat. Nos. 270,555 and 273,029.

Common to these and many other prior art treadmills is that the treadmill deck, belt and walking/running surface remain neutral, flat, horizontal, or otherwise are not adjustable in the lateral direction. Despite the incline provided in the fore/aft direction (analogous to "pitch"), the consistency of the horizontal/orientation (analogous to "roll") leads to excessive repetitive motion, and resulting excessive repetitive wearing on a limited portions of the anatomy, and in particular, limited portions of the joints of the foot, ankle, need, and hip that correspond to the limited (neutral) roll position of the deck.

What is needed is an exercise equipment arrangement that lessens or avoids such excessive repetitive motion, and such resulting excessive repetitive wearing on limited portions of the anatomy.

SUMMARY

The present invention provides exercise equipment arrangements that lessen or avoid excessive repetitive motion, and resulting excessive repetitive wearing on limited portions of the anatomy. More specifically, the present invention provides a treadmill arrangement that allows for lateral tilting of the deck, from side to side (laterally, analogous to "roll"), without, or in addition to, any elevation or incline of the deck from front to rear (longitudinally, analogous to "pitch").

In one embodiment, the present invention provides a lateral tilting system for conventional exercise equipment, such as a treadmill, exercise bicycle, elliptical machine, stair climber, or the like. The conventional exercise equipment may or may not have incline functionality. The lateral tilting system comprises one or more lateral tilt assemblies configured to laterally tilt the conventional exercise equipment. The lateral tilting system may be configured to be a part of, or to couple directly to or support the conventional equipment on a tiltable support surface, and thus tilts the entire conventional equipment, such as a treadmill, including the conventional treadmill's deck.

In another embodiment, the present invention provides a novel treadmill that includes generally conventional components, but further includes a lateral tiling system in accordance with the present invention a treadmill deck that is supported in a fashion providing lateral tilting, e.g., to raise or elevate a left lateral edge relative to a right lateral edge, and/or to raise or elevate a right lateral edge relative to the left lateral edge. Further, the treadmill is configured to cause such tilting to vary during the course of operation.

By varying the lateral tilting of the treadmill's deck (or corresponding portion of other exercise equipment), the lateral tilting system causes a corresponding varying in the use and/or loading of the user's anatomy, which tends to vary loads over a broader range or portion of the joints, etc., and accordingly leads to reduced wearing on a limited portions of the anatomy, and in particular, less wear on limited portions of the joints of the foot, ankle, need, and hip that correspond to the limited (neutral) roll position of the deck etc.

BRIEF DESCRIPTION OF THE DRAWINGS

An understanding of the following description will be facilitated by reference to the attached drawings, in which.

DETAILED DESCRIPTION

For non-limiting illustrative purposes, the present invention is discussed herein with reference to a treadmill-type exercise equipment. It is within the scope of the present invention, however, to adapt the tilting mechanisms described herein to other types of exercise equipment.

Figure 1:
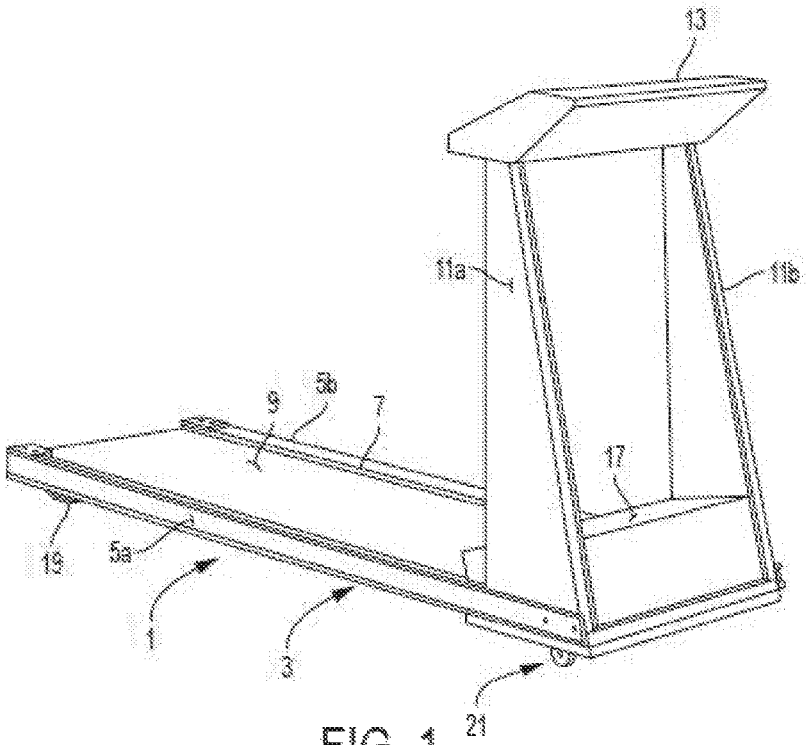
FIG. 1 PRIOR ART
FIGS. 1 and 2 are perspective and side views of an exemplary treadmill providing for fore/aft longitudinal incline of the deck, as is representative of the prior art.
Figure 2:
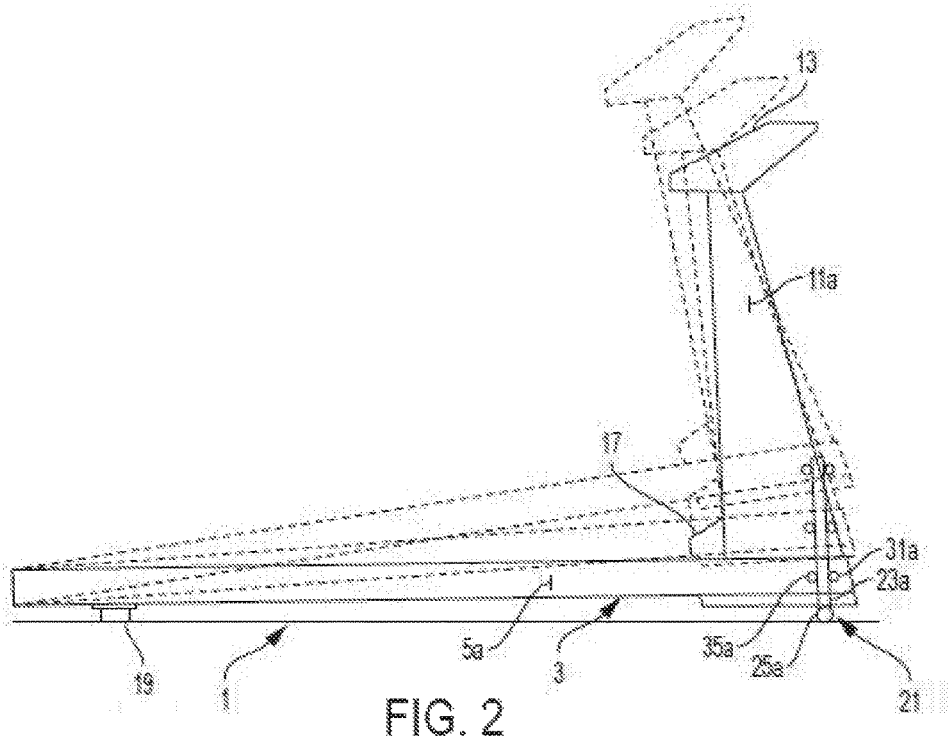
FIG. 2 PRIOR ART

FIGS. 1 and 2 are perspective and side views of an exemplary treadmill providing for fore/aft longitudinal incline of the deck, as is representative of the prior art. This exemplary treadmill is disclosed in U.S. Pat. No. 4,844,449, the entire disclosure of which is hereby incorporated herein by reference. By way of brief example, exemplary prior art exercise treadmill 1 includes a frame, as generally indicated at 3, having a pair of generally horizontally disposed, spaced apart side rails 5*a*, 5*b*. A bed 7 supported by rails 5*a* and 5*b* is disposed between the rails. An endless belt, as generally indicated at 9, is entrained around a front and a rear roller (not shown) interposed between and journaled with respect to side rails 5*a* and 5*b*, with the upper reach of the belt overlying bed 7 such that the upper reach of the belt slides on the bed and is supported by the bed. In this manner, a user of treadmill 1 may walk or jog on the upper surface of the belt supported by the bed. The frame 3 further includes a pair of spaced uprights 11*a*, 11*b* extending generally upwardly from a respective side rail 5*a*, 5*b* at the forward or front end of the frame. A control panel 13 extends transversely between the upper ends of the uprights and a front frame 15 spans between the front ends of side rails 5*a*, 5*b*. As indicated generally at 21, an adjustable elevation system for the treadmill is provided. This treadmill elevation system is operable to cause the bed 7 and upper reach of belt 9 of treadmill 1 to be adjustable between a first position in which they are substantially horizontal, to a raised or elevated position, as shown in FIG. 2, in which the forward end of bed 7 inclines upwardly such that the surface on which a user of the treadmill walks or jogs inclines upwardly or uphill. Consistent with the present invention, the conventional treadmill may have any suitable structure and any suitable elevation mechanism, if any.

Figure 3A:
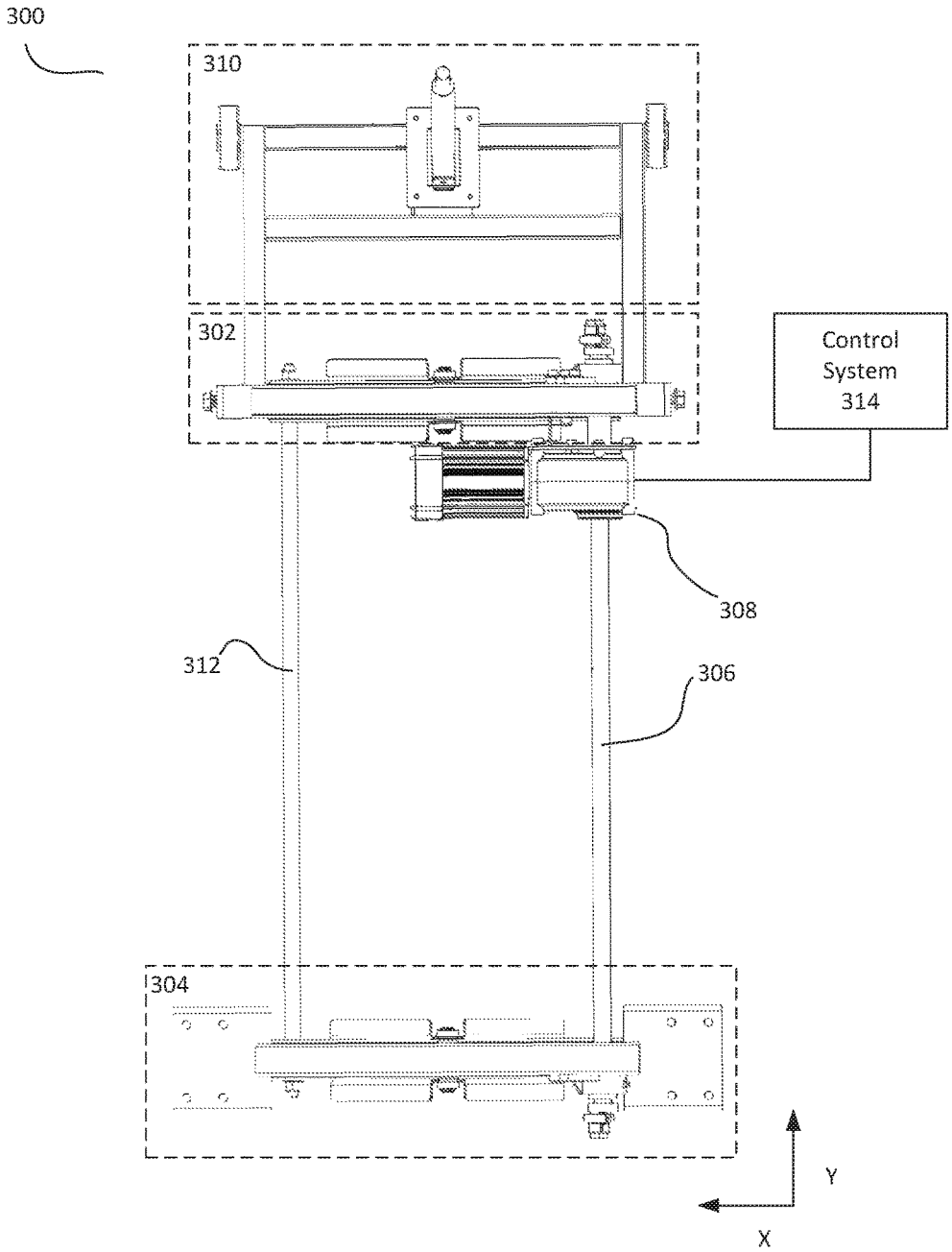
FIGS. 3A and 3B are top and side views, respectively, of an exemplary lateral tilting system in accordance with one embodiment of the present invention.
Figure 3B:
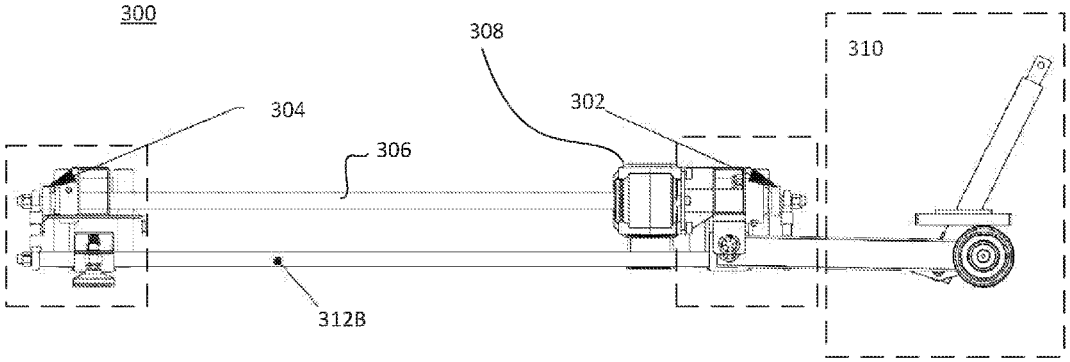

Consistent with the present invention, FIGS. 3A and 3B show a top and side view, respectively, of an exemplary lateral tilting system for a treadmill, in accordance with one embodiment of the present invention. Referring now to FIG. 3A, the exemplary lateral tilting system 300 comprises lateral tilt assemblies 302 and 304, a drive shaft 306 and a drive mechanism 308. In one embodiment, lateral tilt system further comprises a control system, 314, communicatively coupled to the drive mechanism. Further, lateral tilting system 300 may also comprise one or more support braces 312 mechanically coupling lateral tilt assemblies 302 and 304 to each other. In one embodiment, as shown in FIG. 3B, a support brace, 312B, is disposed below drive shaft 306.

Lateral tilting system 300 is mechanically coupled to the deck of a treadmill in a fashion that permits the deck of the treadmill to tilt laterally, from side to side, e.g. to roll about a longitudinally extending axis in the Y-direction, as shown in FIG. 3A. For reference the deck of the treadmill is an elongated deck with a belt extending between two side rails. Any suitable structure may be used to permit lateral tilting system 300 to laterally tilt the deck of the treadmill e.g., to raise or elevate a left lateral edge relative to a right lateral edge, and/or to raise or elevate a right lateral edge relative to the left lateral edge. The left and right lateral edges may refer to the long edges of a treadmill and are parallel to the direction of motion of the treadmill belt. In the exemplary embodiment shown in FIG. 3, lateral tilting system is mechanically coupled to the deck of the treadmill through at least two lateral tilt assemblies, 302 and 304. Although two lateral tilt assemblies are shown, in various embodiments, one or more than two lateral tilt assemblies may be employed. Each lateral tilt assembly comprises a support mechanism configured to be coupled to the deck of the treadmill and to apply lateral tilting movement to the deck. Each lateral tilt assembly includes a crossbeam that is pivotably mounted to a pivot support member, such as base members, 408 or 508, for pivoting motion relative to a first position, and is coupled to the deck. Each lateral tilt assembly engages the ground. In one embodiment, each lateral tilt assembly comprises one or more feet coupled to each respective base member (e.g., 408 and 508) that support lateral tilt system 300 and engage the ground. In another embodiment, lateral tilt assembly 304 comprises one or more feet coupled to base 508 and lateral tilt assembly 302 is coupled to an elevation system (e.g., 310), where that the one or more feet and the elevation system 310 support lateral tilt system 300 and engage the ground. Alternatively, lateral tilt system 300 may comprise one or more feet coupled to its base member while also being coupled to an elevation system. In such an embodiment, the feet may engage the ground while there is no horizontal tilt (longitudinal incline), supporting at least a portion of lateral tilt system 300. Further, the feet may remain engaged with the ground in the when the treadmill is horizontally tilted or the feet may be disengaged from the ground when the treadmill is horizontally tilted. In one embodiment, at least two lateral tilt assemblies are positioned in a spaced longitudinal relationship along the direction of elongation where each lateral tilt assembly includes an upper brace pivotably supported on a lower brace, e.g., by joining the upper and lower braces with a pivot pin.

Figure 4C:
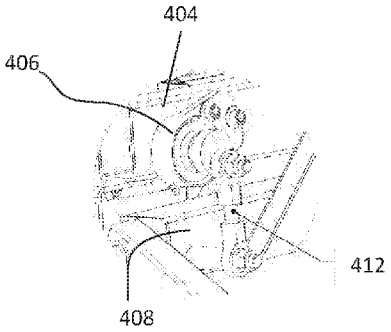
FIGS. 4A, 4B, and 4C are end, top and magnified views, respectively, of an exemplary lateral tilting assembly for a treadmill, in accordance with one embodiment of the present invention.
Figure 4B:
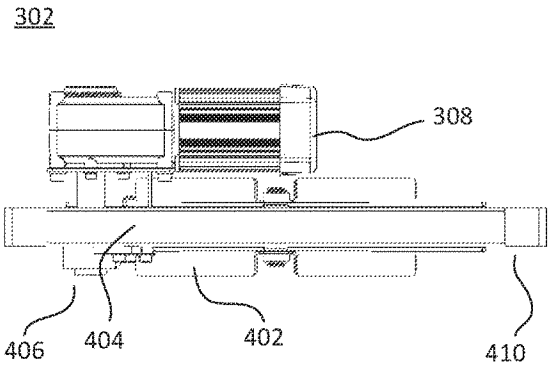
Figure 4A:
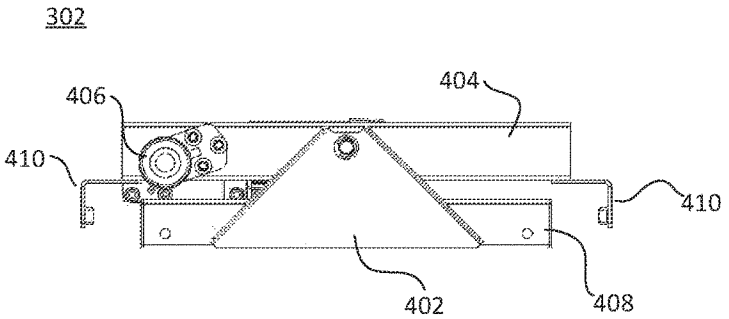

FIG. 4A is an end view of lateral tilting assembly 302 and FIG. 4B is a top view of lateral tilting assembly 302. In the embodiment illustrated in FIGS. 4A and 4B, the lateral tilting assembly 302 comprises a pivot support member 402, crossbeam 404 and drive hub 406. Lateral tilting assembly 302 further comprises base member 408 and connection component 410. Crossbeam 404 is rotatably coupled to pivot support member 402 in a fashion that permits that crossbeam 404 to pivot about a pivot point, e.g., as defined by a pivot pin, bolt of the like. In one embodiment, pivot support member 402 is connected to a central location of crossbeam 404. Pivot support member 402 may be triangular in shape and be coupled to crossbeam 404 adjacent a vertex in a fashion that allows crossbeam 404 to pivot about an axis adjacent the vertex. In one embodiment, connection component 410 is configured to be coupled to the frame of a treadmill deck, or a support for conventional exercise equipment. Further, in one embodiment, drive mechanism 308 is supported on lateral tilting assembly 302, as is shown in FIG. 4B. However, in other embodiments, drive mechanism 308 may be supported on other aspects of lateral tilting system 300.

Drive hub 406 is coupled to a first end of crossbeam 404 and receives drive shaft 306. In one embodiment, drive hub 406 is coupled to crossbeam 404 at a distal location along crossbeam 404. As shown in FIG. 4C, Drive hub 406 may be coupled to a support brace (e.g., 312) passing through base member 408 of tilting assembly 302 through a connecting link arm, connecting link arm 412. Alternatively, drive hub 406 may be coupled directly to base member 408 of tilting assembly 302 through connecting link arm 412. Further, drive hub 406 may be coupled to crossbeam 404 in a fashion that permits that drive hub 406 to transfer motion from drive shaft 306 to crossbeam 404, pivoting crossbeam about pivot member 402. Drive hub 406 transfers motion driven onto drive shaft 306 by drive mechanism 308 to crossbeam 404, causing the end of crossbeam 404 coupled to drive hub 406 and drive shaft 306 to rise and fall. In one embodiment, a pin is eccentrically mounted to drive shaft 306 and is coupled to the connecting link arm, such that axial rotation of draft shaft 306 causes eccentric motion of the pin. The eccentric motion of the pin causes reciprocating motion of the end of the connecting link arm connected to support brace 312 or base member 408, such that reciprocating lateral tilting of the crossbeam 404 is provided.

Figure 5B:
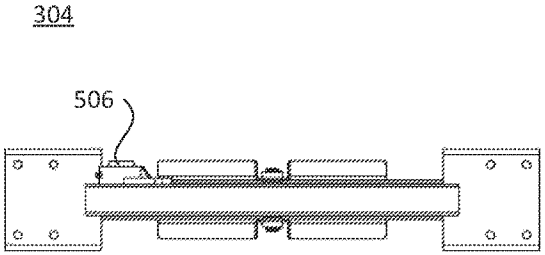
FIGS. 5A and 5B are end and top views, respectively, of an exemplary lateral tilting assembly for a treadmill, in accordance with one embodiment of the present invention.
Figure 5A:
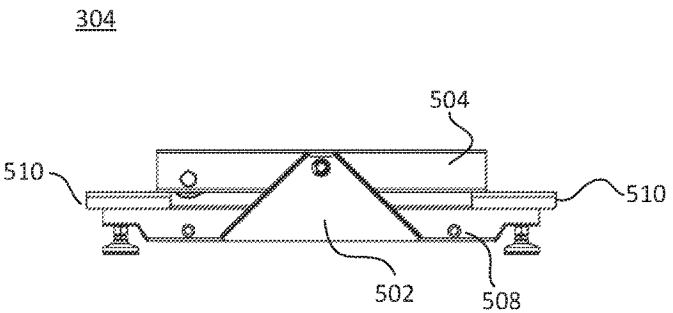

Lateral tilting assembly 304 is illustrated in FIGS. 5A and 5B. FIG. 5A is an end view of lateral tilting assembly 304 and FIG. 5B is a top view of lateral tilting assembly 304. Lateral tilting assembly 304 comprises similar features as lateral tilting assembly 302 and functions in a similar way to laterally pivot the treadmill. In one embodiment, tilting assembly 304 comprises a pivot support member 502, crossbeam 504 and drive hub 506. Crossbeam 504 is pivotably coupled to pivot support member 502 in a fashion that permits that crossbeam 504 to pivot about a pivot point. In one embodiment, pivot support member 502 is coupled to a geometric central location of crossbeam 504. Pivot support member 502 may be triangular in shape and be coupled to crossbeam 504 adjacent a vertex in a fashion that allows crossbeam 504 to pivot about an axis adjacent the vertex. In one embodiment, connection component 510 is configured to be coupled to the frame of a treadmill or a support for conventional exercise equipment.

Drive hub 506 is coupled to a first end of crossbeam 504 and drive shaft 306. In one embodiment, drive hub 506 is coupled to crossbeam 504 at a distal location along crossbeam 504. Drive hub 506 may be coupled to a support brace (e.g., 312) passing through base member 508 of lateral tilt assembly 304 through a connecting link arm. Alternatively, drive hub 506 may be coupled directly to base member 508 of lateral tilt assembly 304 through a connecting link arm. Drive hub 506 may be coupled to crossbeam 504 in a fashion that permits that drive hub 506 to transfer motion to crossbeam 504, pivoting crossbeam about pivot member 502. Drive hub 506 may transfer motion driven onto drive shaft 306 by drive motor 308 to crossbeam 504, causing the end of crossbeam 504 coupled to drive hub 506 and drive shaft 306 to rise and fall. In one embodiment, a pin is eccentrically mounted to drive shaft 306 and is coupled to the connecting link arm, such that axial rotation of draft shaft 306 causes eccentric motion of the pin. The eccentric motion of the pin causes reciprocating motion of the end of the connecting link arm connected to support brace 312 or base member 508, such that reciprocating lateral tilting of the crossbeam 504 is provided. Lateral tilt assembly 304 may further comprise at least one support component configured to be in contact with the ground or floor. Each support component may be adjustable to level the treadmill. Further, each support component may comprise a wheel, such that the treadmill may be moved.

In one embodiment, lateral tilt assembly 302 and lateral tilt assembly 304 are each individually coupled and driven by separate drive motors (e.g., drive mechanism 308). The drive hub of each lateral tilt assembly may be coupled to a respective drive motor by a different drive shaft such that each lateral tilting assembly may be individually driven. Each drive motor may drive a respective drive shaft and, in turn, a drive hub in a manner as described above. In one embodiment, a single drive shaft is driven by each drive motor such that each lateral tilting assemblies are simultaneously driven.

Figure 8:
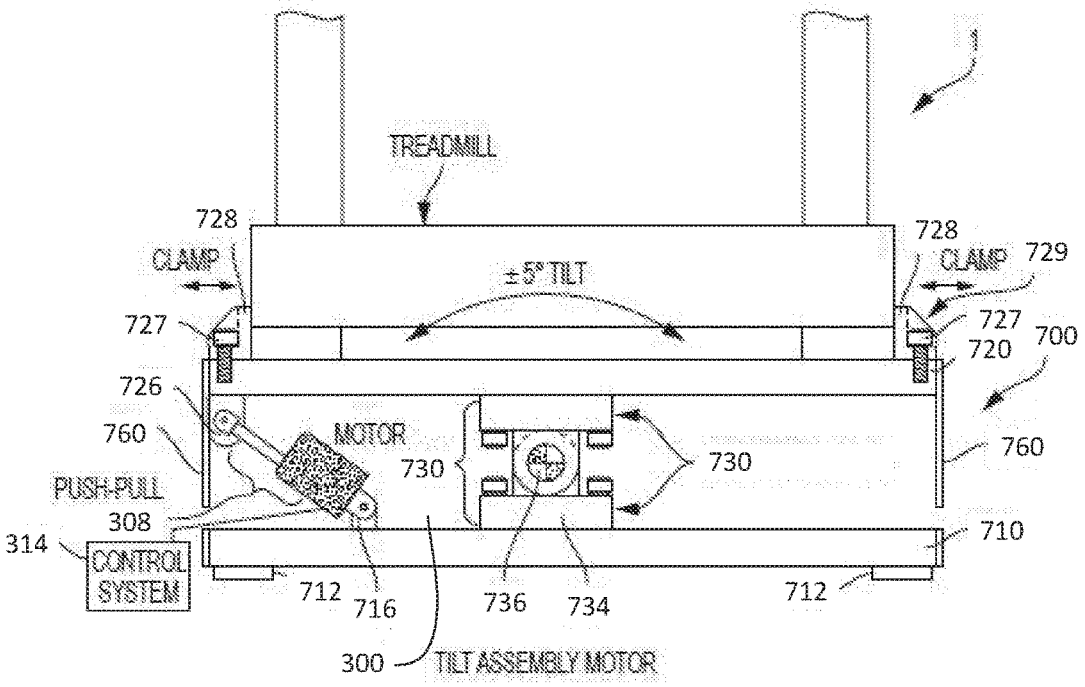
FIG. 8 is an end view of the exemplary lateral tilting accessory of FIG. 7, shown supporting a conventional prior art treadmill.

A drive mechanism 308 is provided for driving the tilt of the lateral tilting system 300 and may be referred to as a drive motor in one or more embodiments. In one embodiment, the drive mechanism includes an electric motor, rotary actuator or linear actuator operable to drive draft shaft 306. As shown in FIGS. 3 and 4B, drive mechanism 308 may be coupled to lateral tilting assembly 302. However, in other embodiments, drive mechanism 308 may be coupled to other features of lateral titling system 300 shown or not shown. The drive mechanism may comprise at least one motor and a gear box coupled to drive shaft 306 and configured to impart motion to the drive shaft, and in response, change the tilt of lateral tilt assemblies 302 and 304 In one embodiment, as shown in FIG. 8, drive mechanism 308 extends one or more actuators, not shown, causing tilt in a first (e.g., clockwise) direction, and operation of the drive mechanism 308 to retract an actuator causes tilt in a second, opposite (e.g., counterclockwise) direction. In another embodiment, drive mechanism 308 extends an actuator of a pivot point causing tilt in a first (e.g., clockwise) direction, and retracts an actuator of a pivot point causing tilt in a second, opposite (e.g., counterclockwise) direction.

Figure 6A:
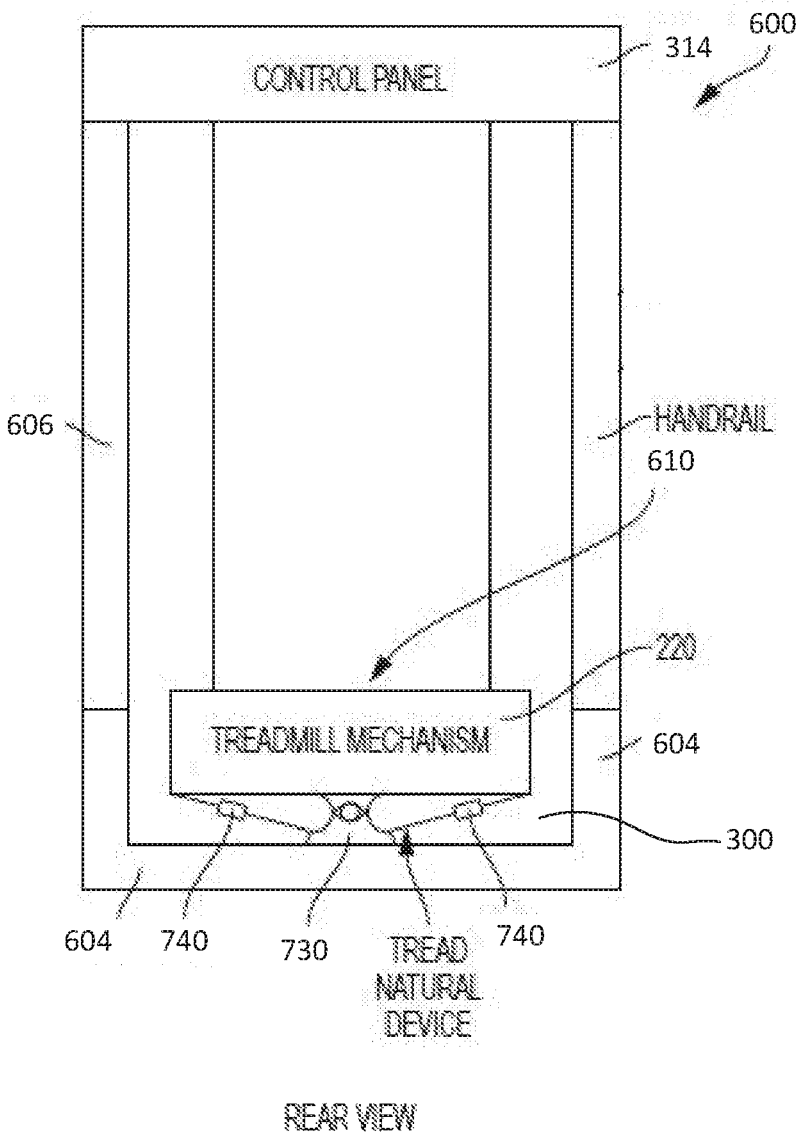
FIGS. 6A and 6B are end and top views, respectively, of an exemplary treadmill device, in accordance with one embodiment of the present invention.
Figure 6B:
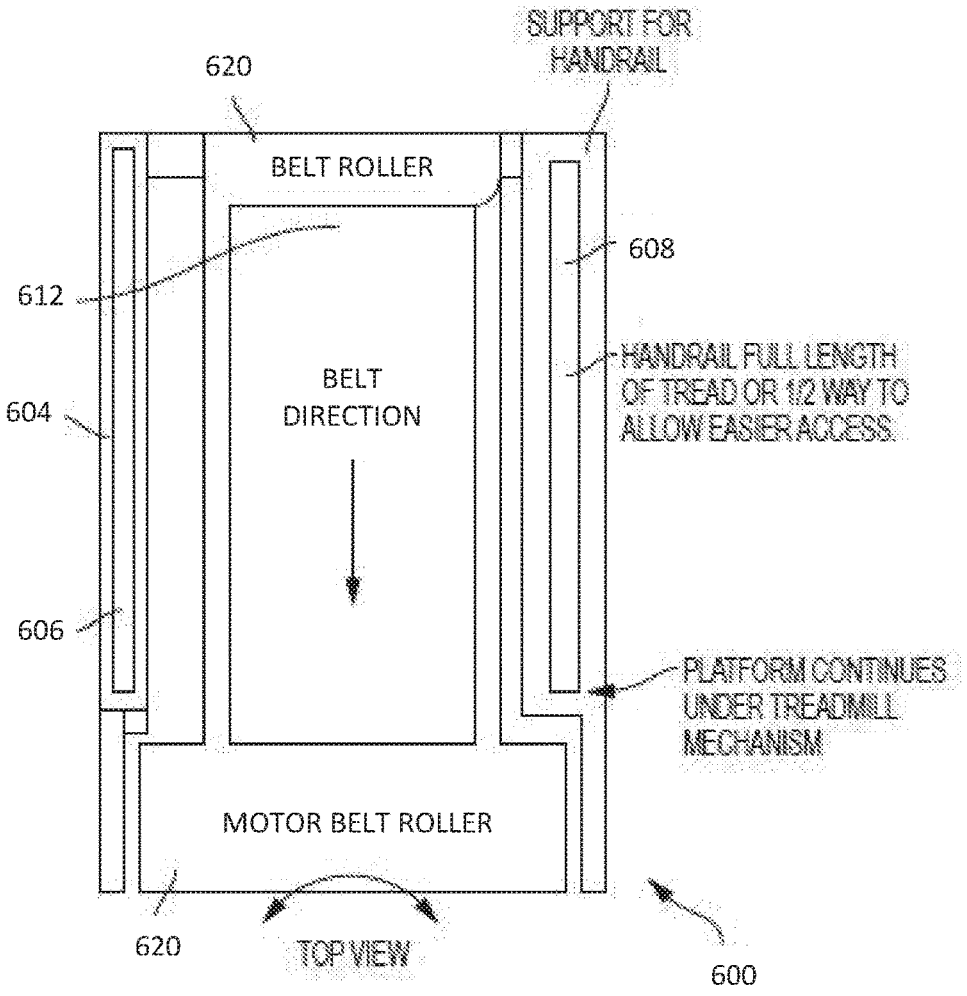

FIGS. 6A and 6B are end and top views, respectively, of an illustrate an alternative embodiment of a treadmill 600 incorporating lateral tilting system 300. In this exemplary embodiment, the treadmill 600 includes many generally conventional components, but further includes in accordance with the present invention a treadmill deck 620 that is supported in a fashion permitting lateral tilting, e.g., to raise or elevate a left lateral edge relative to a right lateral edge, and/or to raise or elevate a right lateral edge relative to the left lateral edge. Further, the treadmill is configured to cause such tilting to vary during the course of operation, e.g., by way control system 314 similar to that described above.

As shown in FIGS. 6A and 6B, the treadmill 600 includes a frame, as generally indicated at 604, having a pair of generally horizontally disposed, spaced apart side rails 606, 608. The frame and side rails are configured to rest in a stable manner upon the floor. The lateral tilting deck 620 is supported by rails 606 and 608 and disposed between the rails. An endless belt, as generally indicated at 612, is entrained around front and rear rollers interposed between and journaled with respect to side rails 606 and 608, with the upper reach of the belt overlying lateral tilting deck 620 such that the upper reach of the belt slides on the lateral tilting deck 620 and is supported by the lateral tilting deck 620. In this manner, a user of treadmill may walk or jog on the upper surface of the belt supported by the lateral tilting deck 620. Optionally, an adjustable elevation system for longitudinally inclining the treadmill may be provided. This elevation system, elevation system 310, is operable to cause the lateral tilting deck 620 and upper reach of belt 612 of the treadmill to be adjustable between a first position in which they are substantially horizontal, to a raised or inclined position, in which the forward end of lateral tilting deck 620 inclines upwardly at an elevation angle such that the surface on which a user of the treadmill walks or jogs inclines upwardly or uphill.

In accordance with the present invention, the lateral tilting deck 620 is further supported for lateral tilting movement, relative to the frame. More specifically, the lateral tilting deck 620 is supported on and mechanically coupled to the frame 604 in a fashion that permits a support table to tilt laterally, from side to side, e.g. to roll about an axis in the X-direction shown in FIG. 7. Any suitable structure may be used to support the lateral tilting deck 620 in a fashion permitting lateral tilting, e.g., to raise or elevate a left lateral edge relative to a right lateral edge, and/or to raise or elevate a right lateral edge relative to the left lateral edge. In the exemplary embodiment shown in FIG. 6B, the lateral tilting deck 620 is mechanically coupled to the frame 604 by lateral tilting system 300. In the illustrated embodiment, lateral tilting system 300 comprises at least two pivot mounts 630 positioned in spaced longitudinal relationship along the direction of elongation of the lateral tilting deck 620. Each pivot mount 630 includes an upper brace 732 pivotably supported on a lower brace 734, e.g., by joining the upper and lower braces 732, 734 with a pivot pin 736. The upper braces 732 are joined to the lateral tilting deck 620 in a manner that does not interfere with the movement of the endless belt about the rollers on which it is supported.

A drive mechanism, e.g., drive mechanism 308, is provided for driving the tilt of the tilting accessory 700. In one embodiment the drive mechanism includes an electric motor or linear actuator operable to extend or retract a drive member, and the drive mechanism is mechanically coupled, e.g. via bosses, yokes or other structures 716, 726 to each of the frame 704 and the lateral tilting deck. In this manner, operation of the drive mechanism 740 to extend an actuator causes tile in a first (e.g., clockwise) direction, and operation of the drive mechanism 740 to retract an actuator causes tilt in a second, opposite (e.g., counterclockwise) direction, as well be appreciated from the exemplary drive mechanism shown in FIG. 8. A similar control system 314 is further provided, and the device operates in a manner similar to that described below.

Control system 314 is provided for supplying power and/or other controls signals to the drive mechanism to cause operation of the drive mechanism. In one embodiment, control system 314 is configured to be responsive to user input, e.g., to tilt the deck of the treadmill in accordance with tilt instructions provided as input by a user. In another embodiment, control system 314 is configured to operate automatically and/or programmatically. For example, in one mode, control system 314 causes tilting of the treadmill deck according to a predefined program/profile, or according to passage of predetermined time intervals, and/or to cycle tilting at a predefined, or user-specified rate. In a preferred embodiment, control system 314 is provided to cause the tilt to be varied in cyclical fashion between a prescribed tilt in each direction. Control system 314 may provide control signals to drive mechanism 308 to drive the lateral tilting assemblies to laterally tilt the treadmill by +/−3°. In other embodiments, treadmill may be laterally tilted by +/−5° or more. Further, control system 314 may provide control signals to vary the rate of lateral oscillation, e.g., between one to three cycles per minute. In other embodiments, the lateral oscillation may be greater than three cycles per minute. In this mode, the tilting varies the loading of the joints/anatomy during walking/running, and tends to better distribute wear/stress over a relatively larger area of joints, etc. In another mode, the control system causes provides a relatively static tilt—e.g., one that does not vary during an intended exercise period. In this mode, the tilting causes loading of the joints/anatomy in a prescribed fashion according to the provided tile, for example to favor one side or another of the body, to accommodate arthritic or pathologic conditions. By way of non-limiting example, these conditions may be present as medial knee arthritis, lateral knee arthritis or in any other joint or bone that would benefit from deviation of the mechanical axis of the body.

In one or more embodiments, lateral tilt system 300 may comprise an adjustable elevation system 310 that may be coupled to lateral tilting assembly 302 to horizontally raise and lower one end of the deck of treadmill, longitudinally inclining the treadmill or another type of exercise equipment. In other embodiments, elevation system 310 may be coupled to other aspects of lateral tilting system 300 or of the treadmill in a fashion that allows elevation system to adjust the incline of the treadmill deck in a conventional fashion. For example, elevation system 310 may be configured to cause an upper reach of the belt of the treadmill to be adjustable between a first position, in which it is substantially horizontal, to a raised or inclined position, in which the forward end of belt inclines upwardly at an elevated angle. Further, elevation system 310 may comprise a conventional treadmill deck incline mechanism, such as a rod component that is inserted into a housing component. As the rod component is driven into or extracted from the housing component, the treadmill is longitudinally inclined. In one embodiment, the rod and housing components are threaded and the rod component is threaded into and out of the housing component to raise and lower the deck of the treadmill. In one embodiment, as the rod component is driven into the housing component, elevation system 310 moves away from a first end of treadmill, lowering the first end decreasing longitudinal incline, and as the rod component is extracted from the housing component, elevation system 310 moves closer to the first end of treadmill, raising the first end of the treadmill and increasing the longitudinal incline. Elevation system 310 may comprise one or more wheels that allow elevation system 310 to move closer to or away from the treadmill, raising and lowering a first end of treadmill, longitudinally inclining the treadmill.

Figure 9A:
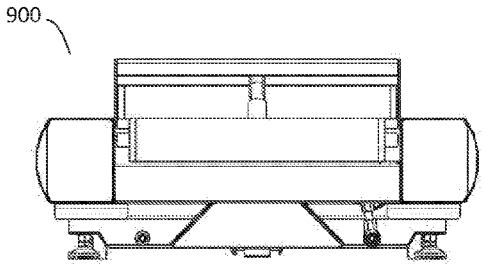
FIGS. 9A-9D depict lateral tilting device in various different stages of lateral tilt and longitudinal incline, in accordance with an exemplary embodiment of the present invention.
Figure 9B:
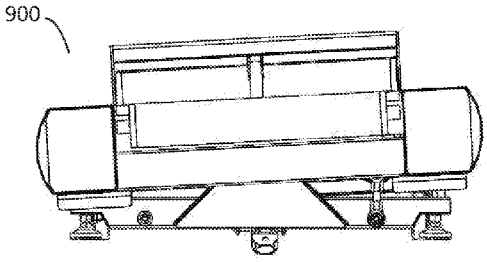
Figure 9C:
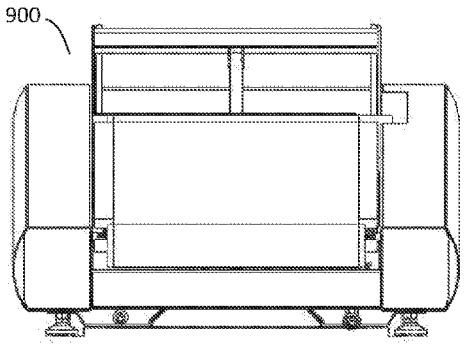
Figure 9D:
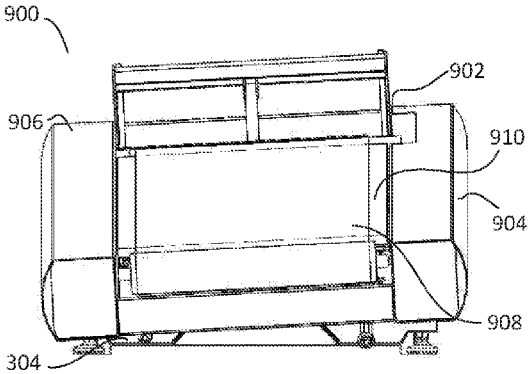

In various embodiments, control system 314 provides control signals drive mechanism 308 to drive to lateral tilting system 300 and/or elevation system 310 to laterally and/or longitudinally incline the treadmill at the same time. In one embodiment, control system 314 instructs drive mechanism 308 to drive lateral tilting device 300 to laterally tilt the treadmill during a first period and elevation system 310 is configured to longitudinally incline the treadmill during a second period, where the first period and second period are at least partially overlapping in time. FIG. 9A illustrates an embodiment where treadmill 900 is neither laterally tilted nor longitudinally inclined. FIG. 9B illustrates an embodiment where treadmill 900 is laterally tilted but not longitudinally inclined. FIG. 9C illustrates an embodiment where treadmill 900 is longitudinally inclined but not laterally tilted. FIG. 9D illustrates an embodiment where treadmill 900 is both laterally tilted and longitudinally inclined.

In one embodiment, lateral tilting system 300 laterally tilts the treadmill from side to side while maintaining the treadmill deck at a constant longitudinal incline. In other embodiments, the longitudinal incline may be adjusted by elevation system 310 while the lateral tilt remains constant. In other embodiments, the lateral tilt and longitudinal incline may be adjusted at the same time.

In accordance with an one embodiment of the present invention, as illustrated in FIG. 9D, treadmill 900 includes many generally conventional components, but further includes in accordance with the present invention a treadmill frame 902 that is supported in a fashion permitting lateral tilting, e.g., to raise or elevate a left lateral edge relative to a right lateral edge, and/or to raise or elevate a right lateral edge relative to the left lateral edge. Further, the treadmill is configured to cause such tilting to vary during the course of operation, e.g., by way of a control system similar to that described above. Treadmill 900 further comprises side rail 904 and 906, deck 910 and belt 908. Frame 902 may be coupled to connection components 410 and 510 of lateral tilting assemblies 302 and 304.

Frame 902 further comprises deck 910 that is disposed between the rails. Deck 910 may be an elongated deck. An endless belt, as generally indicated by 908, is entrained around a front and a rear roller interposed between and journaled with respect to side rails 904 and 906, with the upper reach of the belt overlying deck 610 such that the upper reach of the belt slides on deck 610 and is supported by deck 610.

Treadmill 900 may also comprise one or more handrails, not shown. The handrails may be disposed along the side rails of the deck extending away from the deck of the treadmill in a fashion such that they can be held by a user. In one embodiment, as treadmill 900 is laterally tilted, the handrails do not move in relation to the deck, 910, of the treadmill. The deck of the treadmill may be configured to slide over the handrails such that treadmill may be laterally tilted while the handrails remain at a constant position relative to the deck. Further, the handrails may tilt longitudinally as the deck is longitudinally inclined. In such an embodiment, the handrails may remain at a constant position relative to deck 902 when the deck is longitudinally inclined.

Figures 10A, 10B:
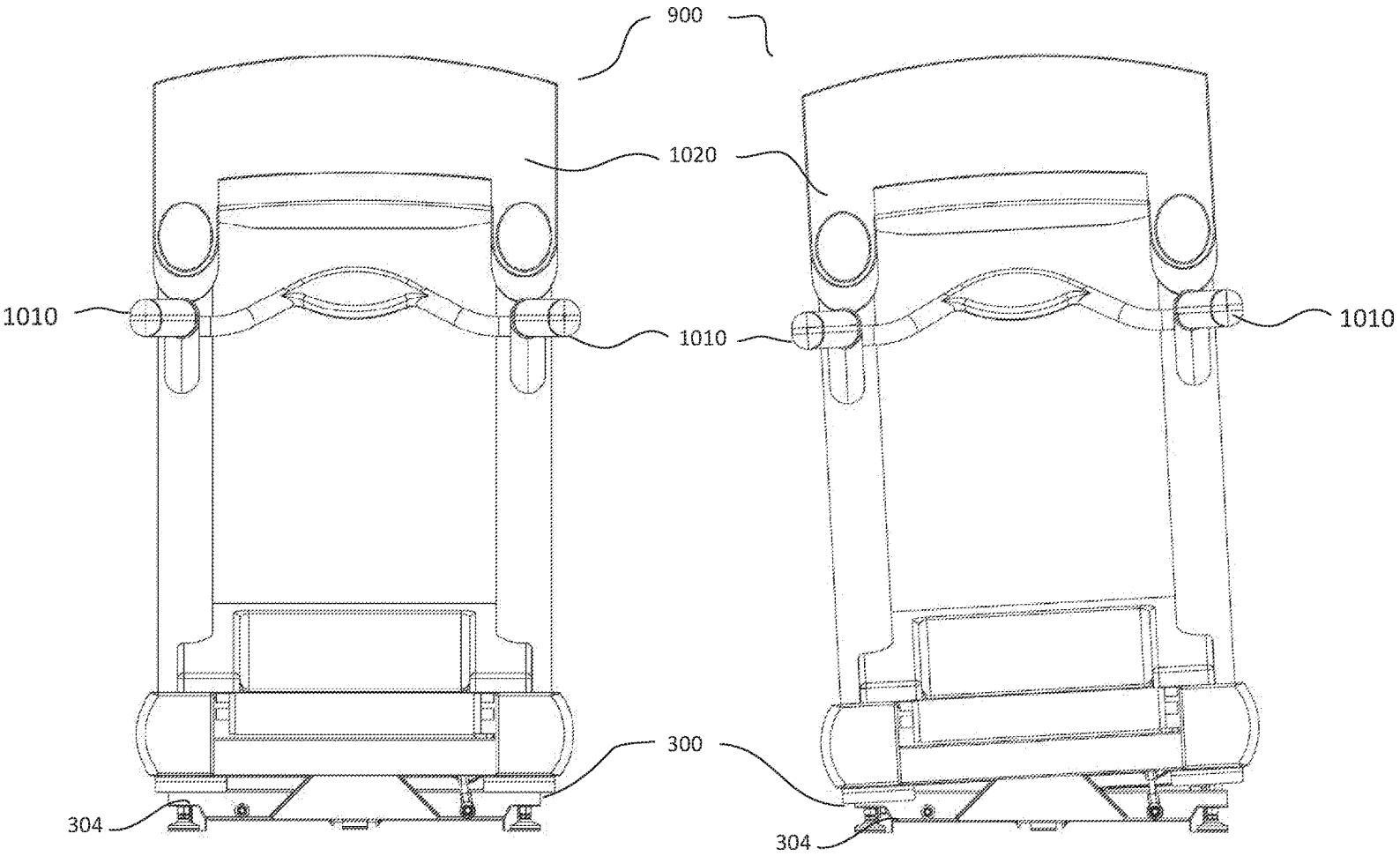
FIGS. 10A and 10B are end views depicting a treadmill including a lateral tilting system, in accordance with an exemplary embodiment of the present invention.

FIGS. 10A and 10B are end views of treadmill 900 comprising handrails 1010 and console 1020 mounted to lateral tilting system 300. In one embodiment, console 1020 houses control system 314. In the embodiment of FIG. 10B, treadmill 900 is laterally tilted by tilting system 300. Further, while a specific configuration of lateral tilting system 300 may be shown in FIGS. 10A and 10B any configuration as described may be implemented. For example, treadmill 900 may be mounted to a support table and then coupled to a lateral titling system 300 as described below.

In one embodiment, lateral tilting system 300 may be coupled to a support table (e.g., 720) that is configured to support conventional exercise equipment. For example, the support table may support a treadmill or a stationary bicycle. However, the support table may be configured to support other types of exercise equipment. In accordance with the present invention, the support table may tilt laterally, from side to side, laterally tilting the exercise equipment. Any suitable structure may be used to support the treadmill in a fashion permitting lateral tilting, e.g., to raise or elevate a left lateral edge relative to a right lateral edge, and/or to raise or elevate a right lateral edge relative to the left lateral edge. For example, one or more lateral tilt assemblies (e.g., 302, 304 and/or 630) may be used to laterally tilt the table.

Figure 7:
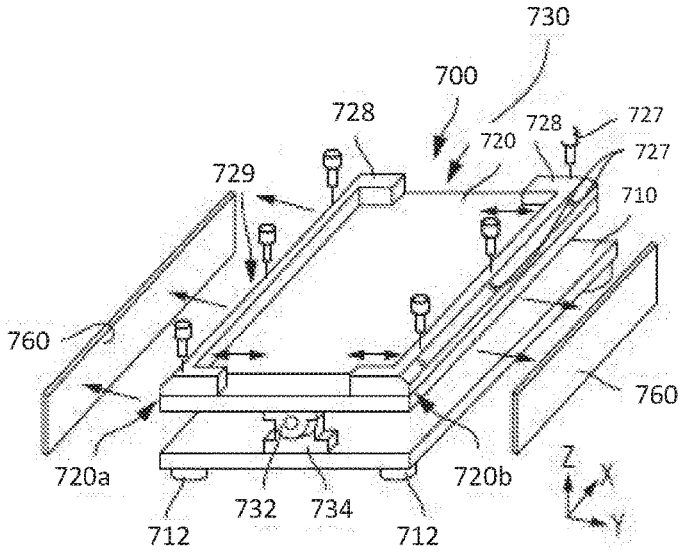
FIG. 7 is a perspective view of an exemplary lateral tilting accessory for conventional exercise equipment, in accordance with one embodiment of the present invention.

Consistent with the present invention, FIGS. 7 and 8 show an exemplary lateral tilting system 300 for a conventional treadmill, in accordance with one embodiment of the present invention. As illustrated, lateral tilting system 300 may be an accessory, lateral tilting accessory 700, coupled to support table 720 or a piece of exercise equipment. Referring now to FIGS. 7 and 8, the exemplary lateral tilting system 300 may include a rigid base 710 on which ground/floor engaging feet 712 are provided.

As is illustrated in FIG. 7, support table 720 may not be square, but rather may be extended in the longitudinal direction (e.g., x-direction in FIG. 3). The support table is supported on and mechanically coupled lateral tilting system 300. Support table 720 is preferably sized to support the base/frame structure of a treadmill or another type of exercise equipment, so that the equipment is wholly supported upon the support table in a manner similar to the manner in which it would be supported on the floor or ground. Support table 720 is thus sufficiently rigid to support the weight of the exercise equipment and the user in secure fashion during operation.

In one embodiment, the support table comprises clamp members that are arranged to provide support at the front, rear, and both sides of a treadmill. The clamp members are configured to extended above a surface of the support table to abut and brace portions of the treadmill's structure, to support the treadmill during tilting. In a preferred embodiment, each clamp member is configured to define a slot for receiving a bolt of other fastener for fixing the clamp member to the support table. Preferably, each of the slots is elongated to allow for lateral or longitudinal adjustment of the clamp member relative to the fastener, to allow the clamp members to be adjusted and fixed in various different positions to abut and brace treadmills having base structures of differing sizes and lengths.

In accordance with the present invention, the support table 720 is mechanically coupled to the base 710 in a fashion that permits the support table to tilt laterally, from side to side, e.g. to roll about the x-axis shown in FIG. 7. Any suitable structure may be used to permit the support table 720 in a fashion permitting lateral tilting, e.g., to raise or elevate a left lateral edge 720*a* relative to a right lateral edge 720*b*, and/or to raise or elevate a right lateral edge 720*b* relative to the left lateral edge 720*a*. In the exemplary embodiment shown in FIGS. 7 and 8, the support table 720 is mechanically coupled to the base 710 by at least two lateral tilt assemblies, each comprising a pivot mount, the pivot mounts positioned in spaced longitudinal relationship along the direction of elongation of the support table 720. Each pivot mount 730 includes an upper brace 732 pivotably supported on a lower brace 734, e.g., by joining the upper and lower braces 732, 734 with a pivot pin 736.

The support table 720 further includes clamp members 728. In a preferred embodiment, the clamp members are arranged to provide support at the front, rear, and both sides of a treadmill, as shown in FIG. 7. The clamp members 728 are configured to extended above a surface of the support table to abut and brace portions of the treadmill's structure, to support the treadmill during tilting. In a preferred embodiment, each clamp member is configured to define a slot 729 for receiving a bolt of other fastener 727 for fixing the clamp member 728 to the support table 720. Preferably, each of the slots 729 is elongated to allow for lateral or longitudinal adjustment of the clamp member relative to the fastener 727, to allow the clamp members to be adjusted and fixed in various different positions to abut and brace treadmills having base structures of differing sizes and lengths, as best shown in FIG. 7. FIG. 8 shows clamps 728 adjusted and fastened to the support table 720 in positions to abut and brace the treadmill base structure.

Optionally, side skirts 760 may be joined along the sides of the support table or treadmill frame, and extending downwardly therefrom to cover a gap between the base and support table, and to reduce the likelihood of hands, feet, or other objects being pinched therebetween during tilting.

Each of the braces preferably includes transversely extending bores permitting each brace to be screwed, bolted, or otherwise joined to one of the base 710 and the support table 720, as best shown in FIG. 8. Further, one or both of the braces preferably includes shoulder disposed and configured to physically abut one another at a maximum lateral tilting angle. In this manner, each brace further acts to provide a mechanical stop to limit sideward tilting. In one embodiment, the braces are configured to provide an equal maximum amount of tilt in each of the lateral directions (e.g., both clockwise and counterclockwise about an axis extending through the braces). In one embodiment, the maximum tilt is preferably limited to no more than 10 degrees from horizontal in each direction, and more preferably is limited to no more than 5 degrees from horizontal in each direction A drive mechanism (e.g., 308) is provided for driving the tilt of the tilting accessory. In one embodiment the drive mechanism includes an electric motor or linear actuator operable to extend or retract a drive member, and the drive mechanism is mechanically coupled, e.g. via bosses, yokes or other structures 816, 826 to each of the base 710 and the support table 720. In this manner, operation of the drive mechanism 308 to extend an actuator causes tile in a first (e.g., clockwise) direction, and operation of the drive mechanism 340 to retract an actuator causes tilt in a second, opposite (e.g., counterclockwise) direction, as well be appreciated from the exemplary drive mechanism shown in FIG. 8.

During operation, a conventional treadmill may be placed on the support table 720 and be supported stably, e.g., by adjusting the clamp members 728 to abut and brace a base structure of the treadmill. The conventional treadmill may then be operated in a conventional fashion, which may include adjustment of the belt speed and/or adjustment of the incline of the treadmill's deck. During operation of the treadmill, lateral tilting system 300 may be operated to cause sideways/lateral tilting of the support table and resulting sideways/lateral tilting of the treadmill's deck. As noted above, the control system may permit various modes of user input and/or cause various modes of tilting, but in any event varies the tilting, and preferably automatically varies the tilting over time, in cyclical fashion.

Varying the lateral tilt of a treadmill during use varies the impact and loading of an upright treadmill user's anatomy, and by varying the tilting over time, results in spreading of the impact and loading over a broader range of the anatomy and joint surfaces that is broader than the limited portion of the anatomy and joint surfaces that are impacted and loaded in a static (non-tilting) arrangement, which in turn reduces repetitive motion/wear on the joints/anatomy, reduces injury, and presently less strain on previously-injured anatomical structures.

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A lateral tilting system for a treadmill, said lateral tilting system comprising:
- a first lateral tilt assembly comprising:
  - a first pivot support member;
  - a first crossbeam pivotably supported on said first pivot support member; and
  - a first drive hub coupled to said first crossbeam;
- a second lateral tilt assembly comprising;
  - a second pivot support member; and
  - a second crossbeam pivotably supported on said second pivot support member; and
  - a second drive hub coupled to said second crossbeam;
- at least one drive shaft coupled to said first drive hub and said second drive hub; and
- a drive mechanism coupled to said at least one drive shaft and configured to drive said drive shaft to pivot said first crossbeam relative to said first pivot support member and to pivot said second crossbeam relative to said second pivot support member.

2. The lateral tilting system of claim 1, wherein said first lateral tilt assembly is configured to be coupled to an elevation system configured to elevate said first lateral tilt assembly relative to said second lateral tilt assembly.

3. The lateral tilting system of claim 2, further comprising a control system communicatively coupled to said drive mechanism, said control system being configured to provide instructions to said drive mechanism to drive said first lateral tilt assembly and said second lateral tilt assembly to laterally tilt said crossbeam during a first period and provide instructions to said elevation system to elevate said first lateral tilt assembly relative to said second lateral tilt assembly during a second period, wherein said first period and second period at least partially overlap.

4. The lateral tiling system of claim 1, further comprising a control system operably connected to said drive mechanism and selectively supplying control signals to said drive motor to cause operation of said drive motor.

5. The lateral tilting system of claim 1, wherein said second lateral tilt assembly comprises at least one support component configured to be in contact with the ground.

6. The lateral tilting system of claim 1 further comprising a support brace mechanically coupling said first lateral tilt assembly to said second lateral tilt assembly.

7. The lateral tilting system of claim 1, wherein said first tilt assembly comprises a first base member coupled to said first drive hub though a first connecting link arm and said second tilt assembly comprises a second base member coupled to said second drive hub though a second connecting link arm.

8. The lateral tilting system of claim 1, wherein said first crossbeam and second crossbeam are supported for pivotal motion about a common axis.

9. The accessory of claim 1, wherein said drive mechanism comprises at least one of an electric motor and a linear actuator operable to extend or retract a drive member.

10. A treadmill comprising:
- an elongated deck supporting an endless belt;
- at least one lateral tilt assembly supporting said elongated deck, said at least one lateral tilt assembly being configured to provide lateral tilting of said elongated deck about a first axis extending in a direction of elongation of said elongated deck;

a drive mechanism operably coupled to said at least one lateral tilt assembly and selectively operable to drive lateral tilting of said elongated deck about said first axis; and a control system operably connected to said drive mechanism and selectively supplying control signals to said drive mechanism to cause operation of said drive mechanism;

wherein said at least one lateral tilt assembly comprises a first lateral tilt assembly and a second lateral tilt assembly:

said first lateral tilt assembly comprising:

a first pivot support member;

a first crossbeam supported on said first pivot support member for pivotable motion relative thereto; and a first drive hub coupled to said first crossbeam; and said second lateral tilt assembly comprises:

a second pivot support member; and a second crossbeam supported on said second pivot support member for pivotable motion relative thereto; and a second drive hub coupled to said second crossbeam.

11. The treadmill of claim 10, further comprising at least one drive shaft coupled to said first drive hub and said second drive hub, and wherein said drive mechanism is coupled to said at least one drive shaft and configured to drive said drive shaft to pivot said first crossbeam and said second crossbeam.

12. The treadmill of claim 10, further comprising an elevation system configured to longitudinally incline said deck.

13. The treadmill of claim 10, wherein said control system communicates instructions to said drive mechanism to drive said first lateral tilt assembly and said second lateral tilt assembly in accordance with said user input.

14. The treadmill of claim 10, wherein said first drive hub comprises a first pin coupled to a drive shaft such that axial rotation of said drive shaft provided by said drive mechanism causes eccentric motion of said pin and reciprocating lateral tilting of said first crossbeam, and said second drive hub comprises a second pin coupled to said drive shaft such that axial rotation of said drive shaft provided by said drive mechanism causes eccentric motion of said pin and reciprocating lateral tilting of said second crossbeam.

* * * * *